US012000313B2

(12) United States Patent
Rezkalla

(10) Patent No.: US 12,000,313 B2
(45) Date of Patent: Jun. 4, 2024

(54) DUAL LATCH PIN TYPE III ROCKER ARM ASSEMBLY

(71) Applicant: Eaton Intelligent Power Limited, Dublin (IE)

(72) Inventor: Ramy Rezkalla, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 9 days.

(21) Appl. No.: 17/642,771

(22) PCT Filed: Sep. 14, 2020

(86) PCT No.: PCT/EP2020/025413

§ 371 (c)(1),
(2) Date: Mar. 14, 2022

(87) PCT Pub. No.: WO2021/047797

PCT Pub. Date: Mar. 18, 2021

(65) Prior Publication Data

US 2022/0397044 A1 Dec. 15, 2022

Related U.S. Application Data

(60) Provisional application No. 62/900,016, filed on Sep. 13, 2019.

(51) Int. Cl.

| | |
|---|---|
| ***F01L 1/18*** | (2006.01) |
| ***F01L 1/46*** | (2006.01) |
| ***F01L 13/00*** | (2006.01) |

(52) U.S. Cl.

CPC ..... *F01L 1/181* (2013.01); *F01L 1/46* (2013.01); *F01L 13/0005* (2013.01);
(Continued)

(58) Field of Classification Search

CPC ..... F01L 1/181; F01L 2001/186; F01L 2001/467; F01L 13/0005

See application file for complete search history.

(56) References Cited

U.S. PATENT DOCUMENTS

| | | | | |
|---|---|---|---|---|
| 5,577,469 | A * | 11/1996 | Muller | F01L 1/181 123/90.16 |
| 2010/0251983 | A1* | 10/2010 | Meistrick | F01L 1/08 123/90.46 |
| 2016/0108780 | A1* | 4/2016 | Sugiura | F01L 13/0005 123/90.16 |

FOREIGN PATENT DOCUMENTS

| | | | | |
|---|---|---|---|---|
| GB | 2272022 | A * | 5/1994 | F01L 13/0005 |
| GB | 2333322 | A * | 7/1999 | F01L 1/2411 |

(Continued)

OTHER PUBLICATIONS

International Search Report and Written Opinion for PCT/EP2020/025413; dated Jan. 14, 2021; pp. 1-11.

*Primary Examiner* — Kenneth J Hansen
*Assistant Examiner* — Kelsey L Stanek
(74) *Attorney, Agent, or Firm* — Pearne & Gordon LLP

(57) ABSTRACT

A rocker arm assembly for pivoting around a rocker shaft comprises a follower side arm, a valve side arm, and a latch assembly. The follower side arm comprises a main body (1016, 2016, 3016), a rocker shaft through-bore (1061), and a follower end (11, 21, 31) comprising a latch through-bore (1019, 2019, 3019). The valve side arm comprises a forked body (1026, 2026) and a valve end (12,22) extending from the forked body. A first arm extension (1025, 2025, 3025) and a second arm extension (1028, 2028, 3028) extend from the forked body and straddle the main body. A first distal end (1125, 2125) comprises a first latch pocket (51) distal from the forked body. A second distal end (1128, 2128) comprises a second latch pocket (81) distal from the forked body. The
(Continued)

latch through-bore selectively aligns with the first latch pocket and the second latch pocket.

14 Claims, 5 Drawing Sheets

(52) U.S. Cl.
CPC ... *F01L 2001/186* (2013.01); *F01L 2001/467* (2013.01); *F01L 2013/001* (2013.01)

(56) References Cited

FOREIGN PATENT DOCUMENTS

| | | | |
|---|---|---|---|
| GB | 2333322 | A | 7/1999 |
| JP | 57193904 | U | 12/1982 |
| JP | 57193906 | U | 12/1982 |
| JP | 6136112 | U | 3/1986 |
| JP | 2013170488 | A | 9/2013 |
| WO | 2019092245 | A1 | 5/2019 |

* cited by examiner

DUAL LATCH PIN TYPE III ROCKER ARM ASSEMBLY

This is a United States § 371 National Stage Application of PCT/EP2020/025413 filed Sep. 14, 2020 and claims the benefit of U.S. provisional application 62/900,016 filed Sep. 13, 2019, all of which are incorporated herein by reference.

FIELD

This application provides a center pivot style rocker arm assembly with dual latch pins and alternative deactivating pivot locations.

BACKGROUND

Type III rocker arms pivot around a rocker shaft and can be called center pivot style rocker arms. The location of the rocker shaft presents advantages in oil feed and, in the case of a simple rocker arm, the advantage of a fixed rotation point. However, there is a desire in the art to add functionality to the type III rocker arm. Now the rocker shaft presents a challenge. The rocker shaft is a rigid parameter in the balance of forces to add motion and functionality.

SUMMARY

The rocker arm assembly disclosed herein overcomes the above disadvantages and improves the art by way of comprising a follower side arm, a valve side arm, and a latch assembly. The follower side arm comprises a main body, a rocker shaft through-bore, and a follower end comprising a latch through-bore. The valve side arm comprises a forked body and a valve end extending from the forked body. A first arm extension and a second arm extension extend from the forked body and straddle the main body. A first distal end comprises a first latch pocket distal from the forked body. A second distal end comprises a second latch pocket distal from the forked body. The latch through-bore selectively aligns with the first latch pocket and the second latch pocket. The latch assembly is seated to selectively latch and unlatch the follower side arm and the valve side arm.

In another embodiment, a rocker arm assembly for pivoting around a rocker shaft comprises a follower side arm, a valve side arm, a latch assembly, and a lost motion spring. The follower side arm comprises a main body, a rocker shaft through-bore through the main body, a first lost motion spring socket, and a follower end comprising a latch through-bore. The valve side arm comprises a forked body and a valve end extending from the forked body. The valve end comprises a second lost motion spring socket. A first arm extension and a second arm extension extend from the forked body and straddle the main body. The first arm extension comprises a first distal end comprising a first latch pocket distal from the forked body. The second arm extension comprises a second distal end comprising a second latch pocket distal from the forked body. The first latch pocket and the second latch pocket align with the latch through-bore. The latch assembly is seated to selectively latch and unlatch the follower side arm and the valve side arm. The lost motion spring spans between the lost motion spring end and the lost motion spring socket.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DETAILED DESCRIPTION

Figure 1A:
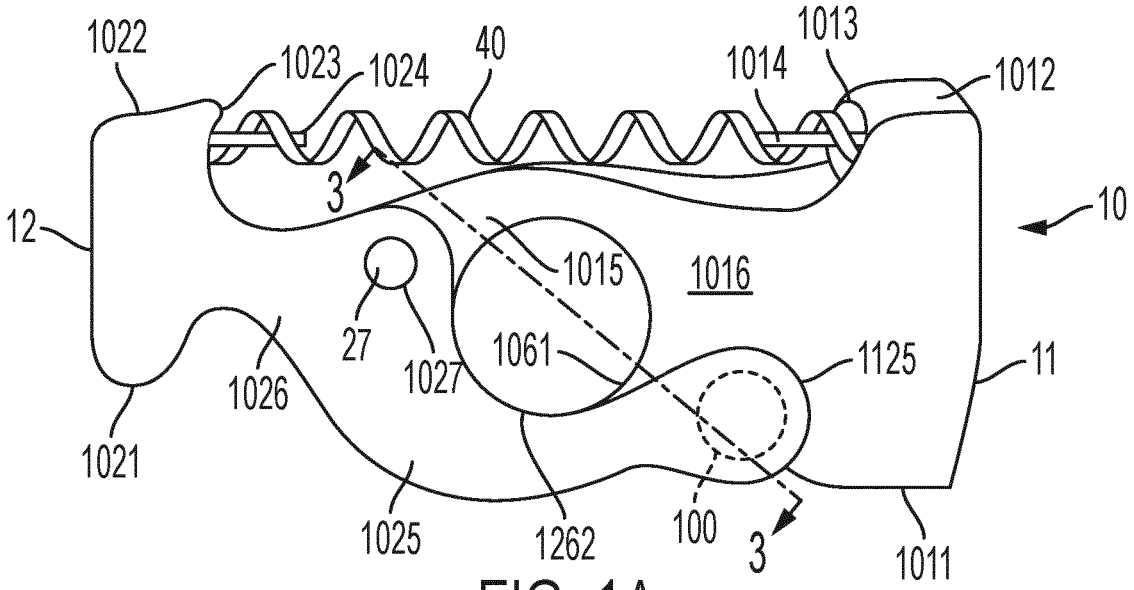
FIGS. 1A & 1B are views of a first rocker arm.

The disclosure provides selectively deactivating rocker arm assemblies 10, 13 with two latch pins 61, 71 configured to selectively latch and unlatch a valve side arm 12, 22 from a follower side arm 11, 21, 31. Follower side arm can also be called a cam side arm, as a follower surface 1011, 2011 such as a flat, round, or roller bearing can ride on a cam lobe or other actuator suitable for moving the rocker arm assembly 10, 13, 14. When the follower surface 1011, 2011 is acted on, a force can be transferred from the follower end 1012, 2012 to the valve end 1022, 2022. A valve or valve bridge associated with the valve seat 1021, 2021 can be actuated on a cylinder of an engine. Valve end 1022, 2022 and valve seat 1021, 2021 can comprise numerous alternatives such as elephant-foot attachments, castellation inserts, hydraulic lash adjuster capsules, among many other valve end devices.

It is desired to add functionality to engine valve trains, and so the ability to add a specific motion to the valve end 1022, 2022 or deactivate that motion is desired. An example comprises cylinder deactivation ("CDA"). In this technique, the valve is not opened or closed for a select amount of time. So, it is desired to deactivate the transfer of force from the follower end 1012, 2013 to the valve end 1022, 2022.

In hydraulically deactivating rocker arms, the deactivating function can be controlled by moving 2 latch pins 61, 71 from their initial position holding both valve and follower side arms 12, 22, 11, 21 together to act as a one solid body (latched, FIG. 3) to two separate arms (unlatched, FIG. 4) with the cam translational motion absorbed by a lost motion spring. One example of a lost motion spring 40 is shown in FIG. 1A, but other alternatives exist in the art.

Several benefits can inure by use of the rocker arm assemblies 10, 13, 14. The dual latch pin design results in lower contact stress compared to VTEC style latch pins. Loads are distributed on two latch pins instead of one. In FIGS. 1A, 1B, & 3, 5, an additional advantage is that there is light weighting while the rocker shaft is going through the follower side arm 11 only instead of both the valve side arm 21 and follower side arm 21. The valve side arm 12, 32 is light weighted by the first arm extension 1025, 3025 and the second arm extension 1028, 3028 being configured to undercut the rocker shaft through-bore 1061, 3061 when the latch assembly latches the follower side arm 11, 31 to the valve side arm 12, 32.

Figure 5:
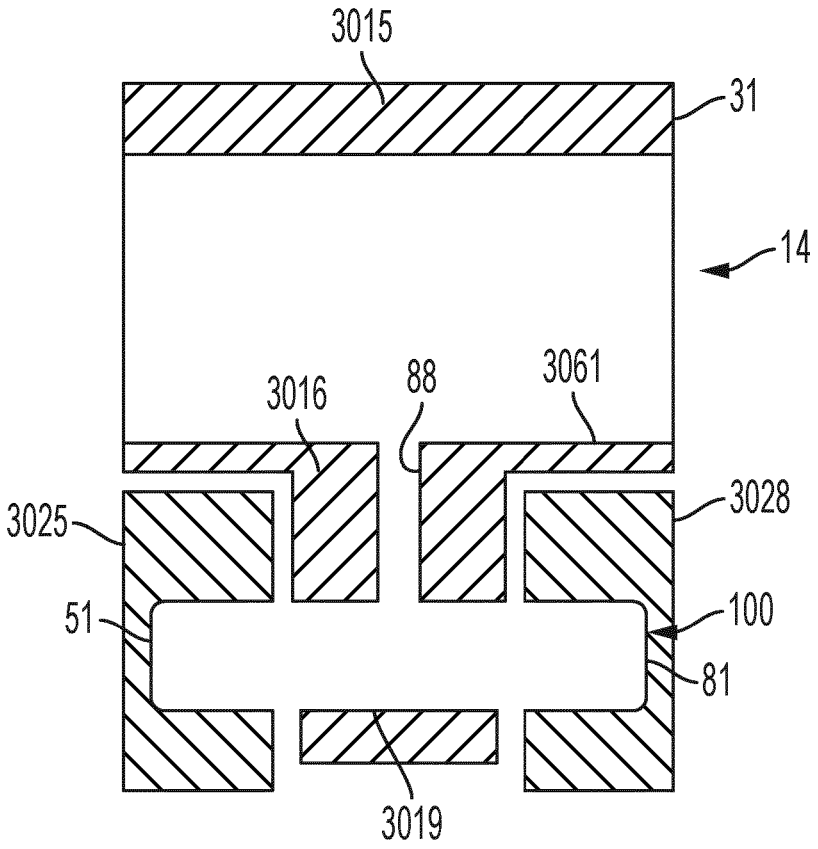
FIG. 5 is a view of a third rocker arm.

As another advantage, shown in FIG. 5, it is possible to gain more material thickness on the follower side arm 31. Here, with the first arm extension 3025 and the second arm extension 3028 being configured to undercut the rocker shaft through-bore 3061, the amount of material in the body portion 3016 and upper body portion 3015 surrounding the rocker shaft can be increased. Now, there is more room for oil communication routing through the follower side arm 31. Oil feeds in addition to oil feed 88 to latch through-bore

3019 can be accomplished. The follower side arm 31 of FIG. 5 can be compatible with teachings of the valve side arm 12 of FIGS. 1A, 1B, & 3.

A rocker arm assembly 10, 13, 14 for pivoting around a rocker shaft can comprise a follower side arm 11, 21, a valve side arm 12, 22, and a latch assembly 101 seated in a latch compartment 100. The latch compartment 100 can comprise latch through-bore 1019, 2019, 2019, first latch pocket 51, and second latch pocket 81. Latch assembly 101 can be installed where latch compartment 100 is shown.

The follower side arm 11, 21, 31 comprises a main body 1016, 2016, 3016, a rocker shaft through-bore 1061, 2061, 3061, and a follower end 1012, 2012 comprising a latch through-bore 1019, 2019, 3019.

The valve side arm 12, 22 comprises a forked body 1026, 2026 and a valve end 1022, 2022 extending from the forked body. A first arm extension 1025, 2025, 3025 and a second arm extension 1028, 2028, 3028 extend from the forked body 1026, 2026 and straddle the main body 1016, 2016, 3016. A first distal end 1125, 2125 comprises a first latch pocket 51 distal from the forked body. A second distal end 1128, 2128 comprises a second latch pocket 81 distal from the forked body. The latch through-bore 1019, 2019, 3019 selectively aligns with the first latch pocket 51 and the second latch pocket 81. The latch assembly 101 is seated to selectively latch and unlatch the follower side arm 11, 21, 31 and the valve side arm 12, 22, 32.

The follower side arm 11, 21, 31 can be biased so that it rides against a cam or other actuator at follower surface 1011, 2011. The biasing can also predispose the follower side arm to return from being deactivated, or unlatched, to activated, or latched. So, the follower side arm 11, 21, 31 can further comprise a first lost motion spring socket 1013, 2013 on the same side of the rocker shaft bore 1061, 2061, 3061 as the follower surface 1011, 2011. The valve end 12, 22 can further comprise a second lost motion spring socket 1023, 2023. A stake 2014, 2024, 1014, 1024 can be included in each spring socket to position a lost motion spring 40. The lost motion spring 40 can span between the first lost motion spring socket 1013, 2013 and the second lost motion spring socket 1023, 2023.

It is possible to characterize the layout of the rocker arm assembly 10, 13, 14 in several ways. It can be said that the components triangulate, or form a triangle-like configuration, around the rocker shaft through-bore 1061, 2061, 3061. The valve end 12, 22, the follower end 11, 21, 31, and the first lost motion spring socket 1013, 2013 can form apexes and triangulate around the rocker shaft through-bore 1061, 2061, 3061. In another characterization of the layout, the rocker arm assembly can be said to form a first extrema opposite to a second extrema. The first and second extrema can comprise portions that are furthest from the rocker shaft through-bore 1061, 2061, 3061. The valve end 12, 22 can be at the second extrema, and the follower end 1012, 2012 can be at the first extrema. If the follower surface 1011, 2011 and first lost motion spring socket 1013, 2013 are on the follower end 1012, 2012, one above the other, then a triangle-like relationship can be formed therebetween around the rocker shaft through-bore 1061, 2061, 3061.

The latch compartment 100 can also be said to have a triangle-like relationship, or triangulation, around the rocker shaft through-bore 1061, 2061, 3061. Latch compartment 100 can be an apex of a triangle along with valve end 12, 22 and the first lost motion spring socket 1013, 2013.

The triangle-like relationships can result in packaging improvements because the latch assembly 101 can be placed under the rocker shaft through-bore 1061, 2061, 3061. The latch assembly 101 position is balanced against the position of the lost motion spring 40, improving the design of the lost motion spring 40. There are many forces transferring, with reaction forces through the pivot pin 27, through the latch assembly 101, and around the rocker shaft positioned in rocker shaft through-bore 1061, 2061, 3061. But, with the force transfer moments triangulated as shown, there is a force reduction in the scissor motion, thereby improving the overall design and actuation of the rocker arm assembly 10, 13, 14.

An oil feed 88 can be formed from the rocker shaft through-bore 1061, 2061, 3061 to the latch through-bore 1019, 2019, 3019. The rocker arm assembly 10, 13, 14 can be installed on a switchable rocker shaft for selective supply of oil pressure through the rocker shaft through-bore to the oil feed 88. By controlling the oil pressure supplied to the oil feed 88, the latch assembly 101 can be switched between latched and unlatched.

The latch assembly 101 can comprise a first latch pin 71 and a second latch pin 61. A front surface 74, 64 can comprise a chamfer, radius, bevel, or other shape suitable for encouraging the desired latching and unlatching. Likewise, first piston 91 and second piston 92 can comprise a front surface 93, 95 comprising a chamfer, radius, bevel or other shape suitable for encouraging the desired latching and unlatching. For example, when the follower side arm 11, 21, 31 is in motion because the latch assembly 101 is unlatched and a cam or other actuator is pushing the follower side arm in a deactivated or lost motion, the edges of the latch through-bore 1019, 2019, 3019 can push the front surface 74, 64 and slide past because of the shape applied to the front surface. Likewise, the front surfaces 93, 95 of the pistons 91, 92 can be pushed upon by the edges of first latch pocket 51 and second latch pocket 81. When the follower side arm 11, 21, 31 returns, via pressure from lost motion spring 40, to the active position for latching of the latch assembly, the shapes of the front surfaces 74, 93, 95, 64 permit sliding and pushing of the follower side arm despite any residual oil pressure from oil feed 88 and any spring pressure from springs 55, 85. Such pushing assists with positioning the latch assembly 101.

First spring 55 in the first latch pocket 51 can press the first latch pin 71 towards the oil feed 88. First latch pocket 51 can comprise an inner wall 53 for guiding the first latch pin 71. A back wall 52 of the first latch pocket 51 provides a surface against which the first spring 55 can be biased. A rear face 72 of first latch pin 71 can face the back wall 52 and can be pressed upon by the first spring 55.

A second spring 85 in the second latch pocket 81 can press the second latch pin 61 towards the oil feed 88. Second latch pocket 81 can comprise an inner wall 83 for guiding the second latch pin 61. A back wall 82 of the second latch pocket 81 provides a surface against which the second spring 85 can be biased. A rear face 62 of the second latch pin 61 can face the back wall 82 and can be pressed upon by second spring 85.

The first piston 91 can be configured to press on the first latch pin 71 when pressurized oil is fed to the latch through-bore 1019, 2019, 3019 via the oil feed 88. The second piston 92 can be configured to press on the second latch pin 61 when pressurized oil is fed to the latch through-bore via the oil feed 88. The pressurized oil can press on rear faces 94, 96 of the first and second pistons 91, 92. The pressurized oil can cause the first spring 55 and the second spring 85 to compress.

Figure 3:
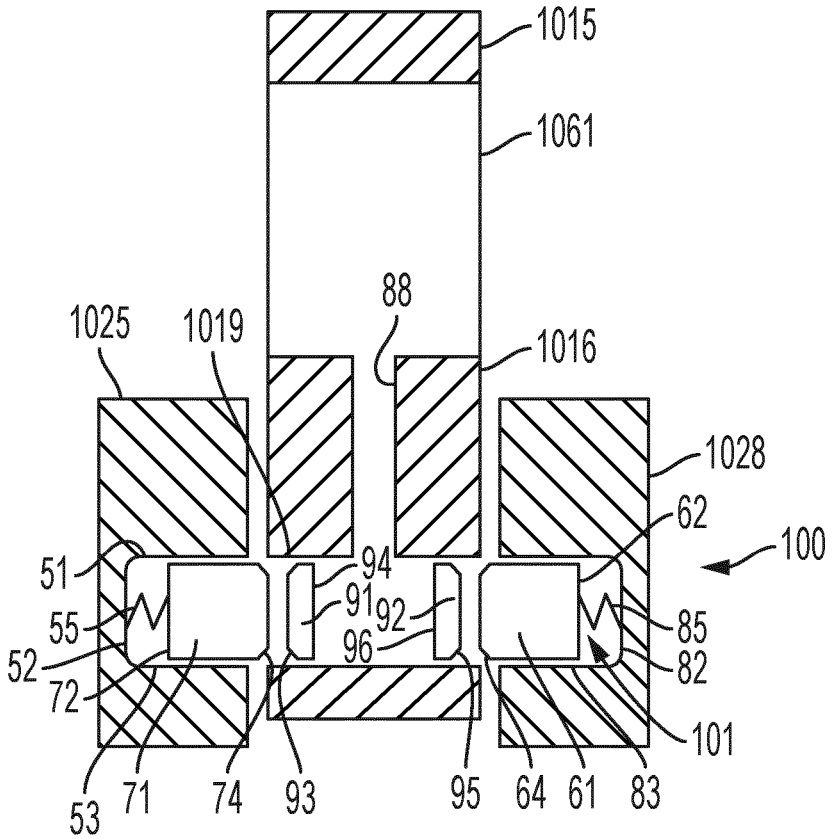
FIG. 3 is a view along the dashed line in FIG. 1A.
Figure 4:
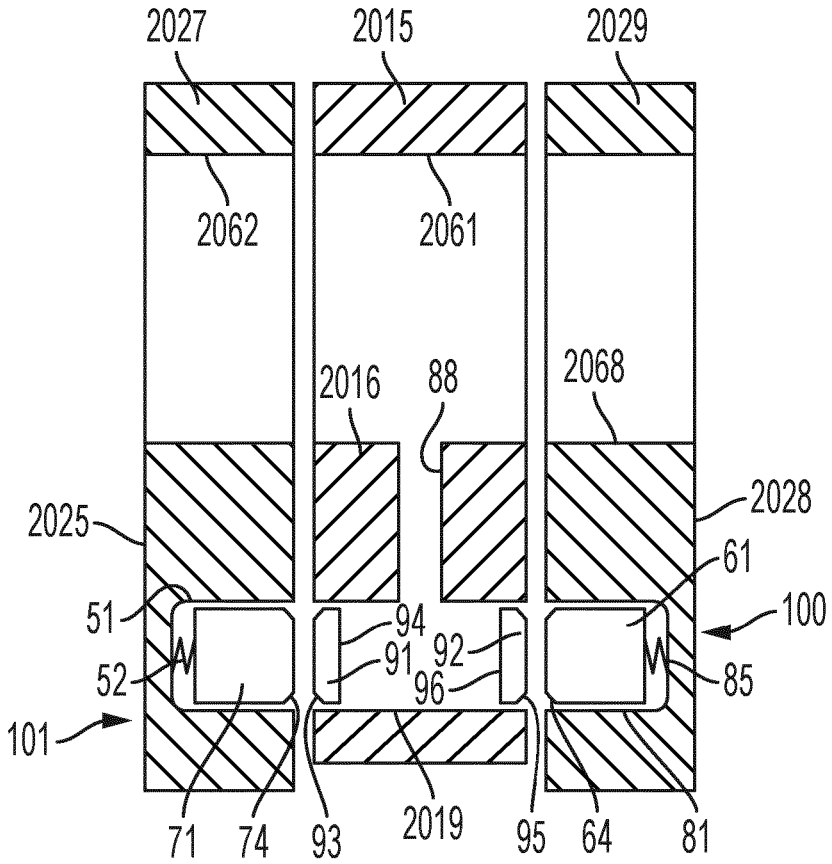
FIG. 4 is a view along the dashed line in FIG. 2A.

FIG. 3 shows that the first latch pin 71 spans between the first latch pocket 51 and the latch through-bore 1019, 2019,

3019 when the latch assembly is latched. But, as shown in FIG. 4, the first latch pin 71 is seated in the first latch pocket 51 but is not seated in the latch through-bore 1019, 2019, 3019 when the latch assembly 101 is unlatched.

FIG. 3 shows that the second latch pin 61 spans between the second latch pocket 81 and the latch through-bore 1019, 2019, 3019 when the latch assembly 101 is latched. But, as shown in FIG. 4, the second latch pin 61 is seated in the second latch pocket 81 but is not seated in the latch through-bore 1019, 2019, 3019 when the latch assembly 101 is unlatched. The first latch pocket can be said to form a first blind bore in the first distal end 1125, 1128 and the second latch pocket form can be said to form a second blind bore in the second distal end 1128, 2128.

Figure 1B:
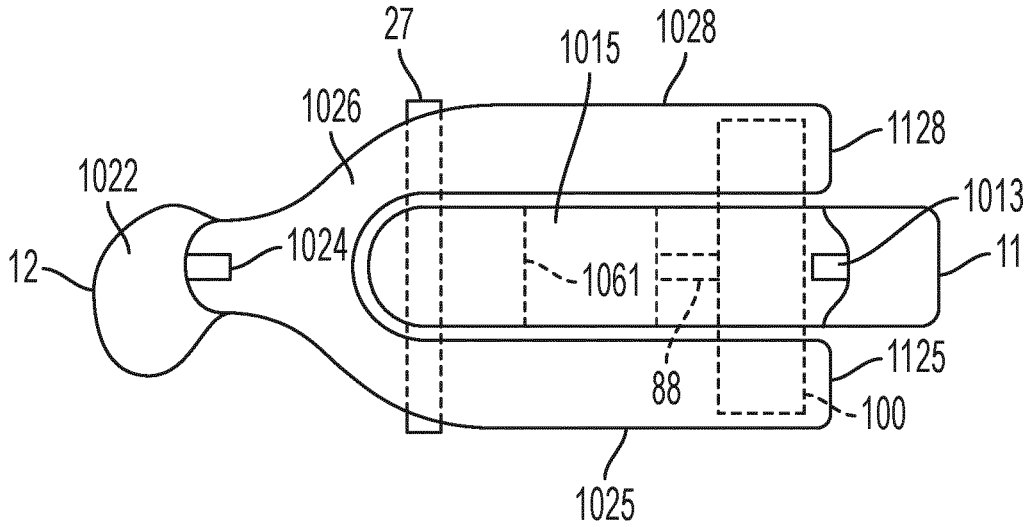

In FIGS. 1A & 1B, and for the configurations of FIGS. 3 & 5, a pivot pin 27 can pass through the forked body 1026 and through the main body 1061. The valve side arm 12 can be configured to pivot about the pivot pin 27 when the latch assembly 101 is unlatched. Such pivoting can contribute to the characterization that the rocker arm assembly is of the "scissor" type, because the valve side arm 12 and follower side arm 11 open like a pair of scissors when the latch assembly 101 is unlatched. The follower side arm 11 can be configured so that it does not transfer enough force through the pivot pin 27 to move the valve seat 1021 when in the latch assembly 101 is deactivated or unlatched. But, the follower end 11 can be configured to transfer sufficient actuation force to the valve end 12 and valve seat 1021 through the pivot pin 27 to move an affiliated valve or valve bridge when the latch assembly 101 is latched.

The first arm extension 1025 and the second arm extension 1028 can be configured to undercut the rocker shaft through-bore 1061 when the latch assembly 101 latches the follower side arm 11 to the valve side arm 12. An undercut edge 1262 can be guided by a rocker shaft installed in the rocker shaft through-bore 1061, or a materials reduction can result in the undercut edge 1262 receding below the rocker shaft through-bore 1061.

In each of the embodiments, the follower side arm 11, 13, 14 comprises an upper body portion 1015, 2015, 3015 to wrap around a rocker shaft installed in the rocker shaft bore 1061, 2061, 3061. The materials reduction of FIGS. 3 & 5 illustrate that there is no mirror shape on the valve side arms 12.

Figure 2A:
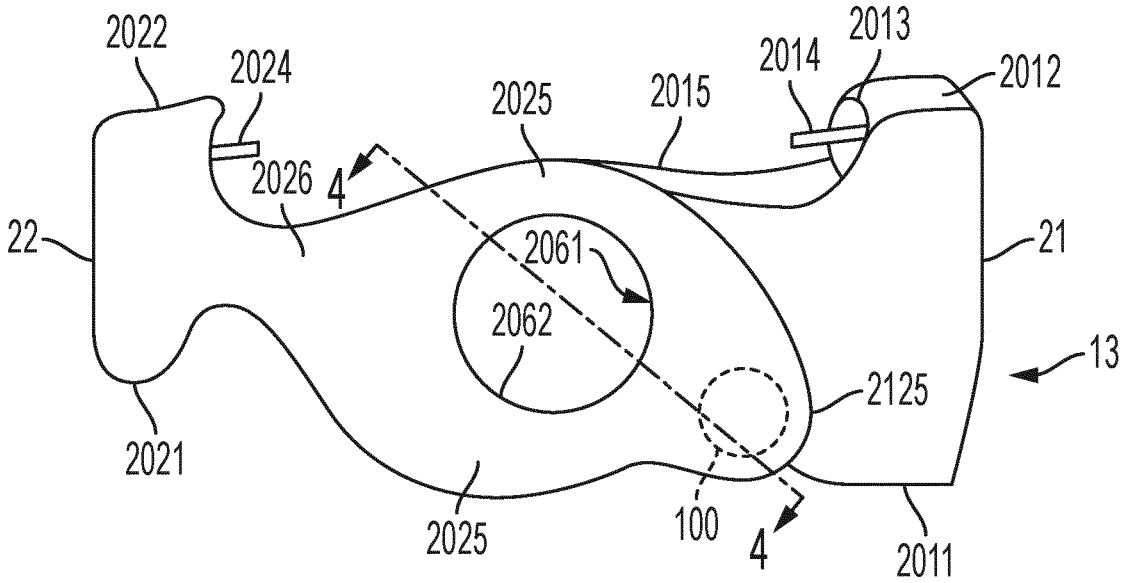
FIGS. 2A & 2B are views of a second rocker arm.
Figure 2B:
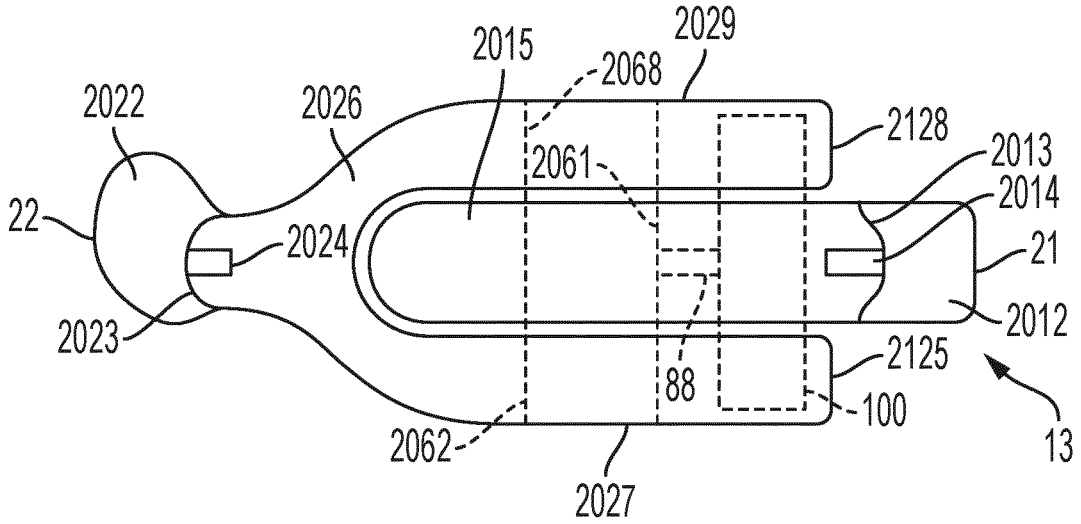

However, in FIGS. 2A, 2B, & 4, rocker arm assembly 13 comprises a first rocker shaft cradle 2027 extending from the forked body 2026 to the first distal end 2125. A second rocker shaft cradle 2029 extends form the forked body 2026 to the second distal end 2128. The first rocker shaft cradle 2027 is configured with the first arm extension 2025 to pivot about a rocker shaft as by a first valve side rocker shaft through-bore 2062. The second rocker shaft cradle 2029 is configured with the second arm extension 2028 to pivot about the rocker shaft as by a second valve side rocker shaft through-bore 2068. In this configuration, the pivot pin 27 is omitted. When the latch assembly is unlatched, the valve side arm 22 can pivot about the rocker shaft via first valve side rocker shaft through-bore 2062 and second valve side rocker shaft through-bore 2068.

Other implementations will be apparent to those skilled in the art from consideration of the specification and practice of the examples disclosed herein.

What is claimed is:

1. A rocker arm assembly for pivoting around a rocker shaft, comprising:

a follower side arm, comprising:

a main body;

a rocker shaft through-bore through the main body; and a follower end comprising a latch through-bore;

a valve side arm, comprising:

a forked body;

a valve end extending from the forked body; and a first arm extension and a second arm extension extending from the forked body and straddling the main body, the first arm extension comprising a first distal end comprising a first latch pocket distal from the forked body, the second arm extension comprising a second distal end comprising a second latch pocket distal from the forked body, and the latch through-bore selectively aligns with the first latch pocket and the second latch pocket; and a latch assembly seated to selectively latch and unlatch the follower side arm and the valve side arm, wherein the follower side arm further comprises a first lost motion spring socket, wherein the valve end further comprises a second lost motion spring socket, and wherein a lost motion spring spans between the first lost motion spring socket and the second lost motion spring socket.

2. The rocker arm assembly of claim 1, wherein the valve end, the follower end, and the first lost motion spring socket form apexes of a triangulation around the rocker shaft through-bore.

3. The rocker arm assembly of claim 1, comprising a first extrema opposite to a second extrema, wherein the valve end is at the second extrema, and wherein the follower end is at the first extrema.

4. The rocker arm assembly of claim 1, comprising an oil feed from the rocker shaft through-bore to the latch through-bore.

5. The rocker arm assembly of claim 4, wherein the latch assembly comprises:

a first latch pin;

a second latch pin;

a first spring in the first latch pocket pressing the first latch pin towards the oil feed; and a second spring in the second latch pocket pressing the second latch pin towards the oil feed.

6. The rocker arm assembly of claim 5, wherein the latch assembly further comprises:

a first piston configured to press on the first latch pin when pressurized oil is fed to the latch through-bore via the oil feed; and a second piston configured to press on the second latch pin when pressurized oil is fed to the latch through-bore via the oil feed.

7. The rocker arm assembly of claim 5, wherein the first spring and the second spring are configured to compress when pressurized oil is fed to the latch through-bore via the oil feed.

8. The rocker arm assembly of claim 5, wherein the first latch pin spans between the first latch pocket and the latch through-bore when the latch assembly is latched, and wherein the first latch pin is seated in the first latch pocket but not in the latch through-bore when the latch assembly is unlatched.

9. The rocker arm assembly of claim 8, wherein the second latch pin spans between the second latch pocket and the latch through-bore when the latch assembly is latched, and wherein the second latch pin is seated in the second latch pocket but not in the latch through-bore when the latch assembly is unlatched.

10. The rocker arm assembly of claim 1, wherein the first latch pocket forms a first blind bore in the first distal end, and wherein the second latch pocket forms a second blind bore in the second distal end.

11. The rocker arm assembly of claim 1, further comprising a pivot pin passing through the forked body and through the main body, and wherein the valve side arm can be configured to pivot about the pivot pin when the latch assembly is unlatched.

12. The rocker arm assembly of claim 11, configured so that the follower end transfers actuation force to the valve end through the pivot pin when the latch assembly is latched.

13. The rocker arm assembly of claim 11, wherein the first arm extension and the second arm extension are configured to undercut the rocker shaft through-bore when the latch assembly latches the follower side arm to the valve side arm.

14. The rocker arm assembly of claim 1, further comprising a first rocker shaft cradle extending from the forked body to the first distal end and a second rocker shaft cradle extending from the forked body to the second distal end, wherein the first rocker shaft cradle is configured with the first arm extension to pivot about a rocker shaft, and wherein the second rocker shaft cradle is configured with the second arm extension to pivot about the rocker shaft.

* * * * *